US012409959B2

(12) United States Patent
Le Faou et al.

(10) Patent No.: US 12,409,959 B2
(45) Date of Patent: Sep. 9, 2025

(54) FILLING HEAD FOR A DEVICE FOR DISPENSING A FLUID PRODUCT HAVING A VALVE

(71) Applicant: APTAR FRANCE SAS, Le Neubourg (FR)

(72) Inventors: Philippe Le Faou, Ecully (FR); Benjamin Manon, Ecully (FR)

(73) Assignee: APTAR FRANCE SAS, Le Neubourg (FR)

( * ) Notice: Subject to any disclaimer, the term of this patent is extended or adjusted under 35 U.S.C. 154(b) by 0 days.

(21) Appl. No.: 18/688,924

(22) PCT Filed: Sep. 5, 2022

(86) PCT No.: PCT/FR2022/051673
§ 371 (c)(1),
(2) Date: Mar. 4, 2024

(87) PCT Pub. No.: WO2023/031569
PCT Pub. Date: Mar. 9, 2023

(65) Prior Publication Data

US 2025/0128839 A1 Apr. 24, 2025

(30) Foreign Application Priority Data

Sep. 6, 2021 (FR) ..... 2109322

(51) Int. Cl.
*B65B 31/00* (2006.01)
*B65B 3/12* (2006.01)
(Continued)

(52) U.S. Cl.
CPC ..... *B65B 3/12* (2013.01); *B65B 31/003* (2013.01); *B65B 39/004* (2013.01); *B65D 83/425* (2013.01)

(58) Field of Classification Search
CPC ..... B65B 39/004; B65B 31/003; B65B 3/12; B65D 83/52; B65D 83/425
(Continued)

(56) References Cited

U.S. PATENT DOCUMENTS 3,176,727 A 4/1965 Rousseau
3,234,707 A 2/1966 Weston
(Continued)

OTHER PUBLICATIONS

International Search Report of PCT/FR2022/051673 dated Dec. 13, 2022 [PCT/ISA/210].
(Continued)

*Primary Examiner* — Jason K Niesz
(74) *Attorney, Agent, or Firm* — Sughrue Mion, PLLC

(57) ABSTRACT

A filling head for a device having a valve with a valve shutter, the head having a body having a receiving space, a control member that slides in the body between rest and filling positions, the member having a channel that opens into the receiving space, a ring fixed to the member and cooperating with a spring disposed between the ring and the body, and a plate fixed to the body and a housing for receiving the valve, such that, in the filling position, the valve shutter opens into the receiving space. In the filling position, the receiving space is sealed off, having a first seal between the control member and the body, a second seal between the body and the receiving plate, and a third seal between the receiving plate and the valve shutter, the third seal cooperating with an external lateral wall of the valve shutter.

9 Claims, 3 Drawing Sheets

Figure 1:
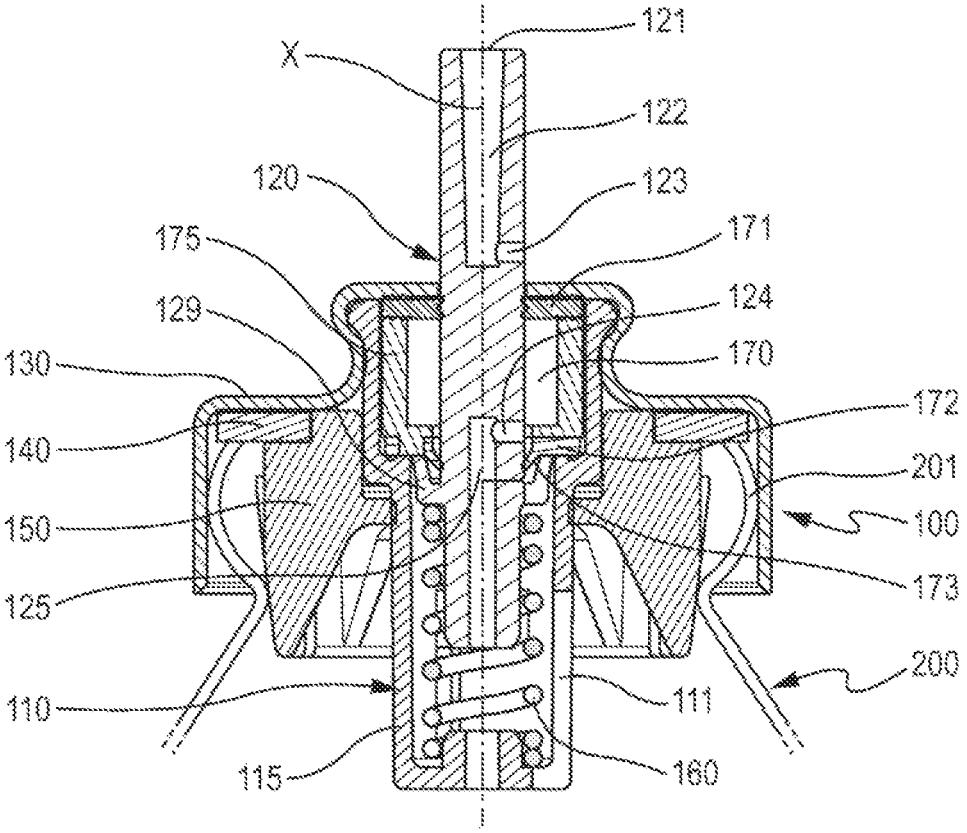

(51) Int. Cl.
*B65B 39/00* (2006.01)
*B65D 83/42* (2006.01)

(58) Field of Classification Search
USPC ..... 141/18, 20
See application file for complete search history.

(56) References Cited

U.S. PATENT DOCUMENTS

| | | | | |
|---|---|---|---|---|
| 4,727,914 | A | 3/1988 | Anderson, III et al. | |
| 4,917,156 | A | 4/1990 | Varlet | |
| 6,948,534 | B1 * | 9/2005 | Hirz | B65B 31/003 141/20 |
| H2205 | H | 11/2007 | Andersen et al. | |
| 2005/0005995 | A1 * | 1/2005 | Pericard | B65B 31/003 141/20 |
| 2009/0038708 | A1 * | 2/2009 | Hirz | B65B 31/003 222/402.1 |

OTHER PUBLICATIONS

International Preliminary Report on Patentability with Translation of Written Opinion dated Mar. 5, 2024 in Application No. PCT/FR2022/051673.

* cited by examiner

FILLING HEAD FOR A DEVICE FOR DISPENSING A FLUID PRODUCT HAVING A VALVE

CROSS REFERENCE TO RELATED APPLICATIONS

This application is a National Stage of International Application No. PCT/FR2022/051673 filed on Sep. 5, 2022, claiming priority based on French Patent Application No. 2109322 filed on Sep. 6, 2021.

The present invention relates to a filling head for a device for dispensing a fluid product comprising a valve, in particular a metering valve.

What are known as metering valves, in which a precise dose of fluid product is dispensed upon each actuation of the valve, are well known in the art, and are generally assembled on a reservoir containing the fluid product and a propellant used to expel the dose.

The reservoir of a device for dispensing a fluid product comprising a valve, in particular a metering valve, is generally filled by means of a filling device which sends a flow of pressurized fluid product through the valve shutter of the valve. To this end, the valve shutter of the valve is inserted into a filling head which actuates the valve by moving the valve shutter towards its dispensing position and which then injects the fluid product through the outlet orifice of the valve shutter. In the case of a metering valve, the fluid product passes through the valve shutter and enters the metering chamber and from there into the reservoir, deforming the chamber gasket. Typically, the filling pressure is between 5 and 10 bars, which is sufficient to deform the chamber gasket, which typically deforms from a pressure of 2 to 3 bars.

A disadvantage with filling heads of this type is the variability of the position of the valve shutter during filling. In fact, the fully actuated position of the valve shutter in a metering valve, also called the bottom dead centre, can be defined by contiguous turns of the valve shutter spring, with great potential for variability. While this does not pose any difficulties when using the valve to dispense the doses of fluid product, since the dose is dispensed before the valve shutter reaches its end position, this indeterminacy in the position of the valve can generate problems during the filling phase. This is further amplified when the seal between the valve shutter and the filling head is produced on the upper axial edge of the valve shutter, since crushing of the gasket at this point can also contribute to a variability in the final position of the valve shutter at the time of filling.

Another disadvantage of filling heads is linked to the stress exerted by the filling head on the valve body, which can generate malfunctions of the valve, for example in the event of deformation of the valve body.

Documents U.S. Pat. Nos. 3,234,707 and 4,917,156 describe state of the art devices.

The aim of the present invention is to provide a filling head for a device for dispensing a fluid product which comprises a valve that does not have the aforementioned disadvantages.

Another aim of the present invention is to provide such a filling head with improved reliability of filling.

The present invention also aims to provide such a filling head wherein the indeterminacy and variability in the filling position has been eliminated.

The present invention further aims to provide such a filling head wherein the stresses on the valve body during filling have been limited.

The present invention also aims to provide such a device which is simple and inexpensive to manufacture and assemble and which is reliable in use.

The present invention therefore concerns a filling head for a device for dispensing a fluid product, comprising a valve mounted on a reservoir by means of a securing element, said valve comprising a valve shutter provided with an axial outlet orifice sliding in a valve body, said filling head comprising:

- a body comprising a receiving space,
- a control member mounted so as to slide axially in said body between a rest position and a filling position, said control member comprising a filling channel through which, in the filling position, the pressurized fluid is fed to said valve in order to fill said reservoir, said filling channel comprising an outlet orifice opening into said receiving space,
- an upper plate through which said control member passes and which is secured to said body,
- a supporting ring secured to said control member and cooperating with a first spring disposed between said supporting ring and said body,
- a receiving plate secured to said body and comprising a housing for receiving said valve such that, in the filling position, the axial outlet orifice of said valve shutter opens into said receiving space, in which, in the filling position, said receiving space has a seal comprising a first gasket between said control member and said body, a second gasket between said body and said receiving plate, and a third gasket between said receiving plate and said valve shutter, said third gasket cooperating with an outer side wall of said valve shutter, and
- valve ejection means for ejecting said valve from said housing after filling, said ejection means comprising:

- an ejector cylinder disposed in said body,
- at least one ejector which is axially displaceably disposed in said body between an ejection position and a filling position, each ejector being disposed between said ejector cylinder and said support plate, each ejector comprising an enlarged head and a stem extending axially downwards from said enlarged head, said stem passing through said body and said receiving plate in order to project into said housing in the ejection position, and
- a second spring disposed between said ejector sleeve and said upper plate and biasing said at least one ejector towards its ejection position.

Advantageously, said first gasket is a dynamic gasket formed by an O-ring gasket or X-ring gasket assembled in a groove or recess of said control member.

Advantageously, said second gasket is a static gasket formed by an O-ring gasket or X-ring gasket wedged between said body and said receiving plate.

Advantageously, said third gasket is a dynamic gasket formed by an O-ring gasket or X-ring gasket disposed in a suitable recess of said receiving plate.

Advantageously, in the filling position, said filling head forms only two contact zones with said valve, the first contact zone being produced between said control member and said valve shutter and the second contact zone being produced between said support plate or an element connected to said support plate and a radially outer portion of said securing element.

Advantageously, three ejectors are provided, spaced 120° apart.

Advantageously, said receiving space is formed in a hollow cylindrical sleeve of the body in which said control member slides axially in a sealed manner between its rest and filling positions.

The present invention also concerns an assembly formed by a filling head as described above and a device for dispensing a fluid product comprising a valve mounted on a reservoir by means of a securing element.

Advantageously, said valve comprises a valve shutter provided with an axial outlet orifice sliding in a valve body, in which, in the filling position, said valve shutter is disposed in said receiving space of said body and said securing element is disposed in said housing of said receiving plate.

Figure 2:
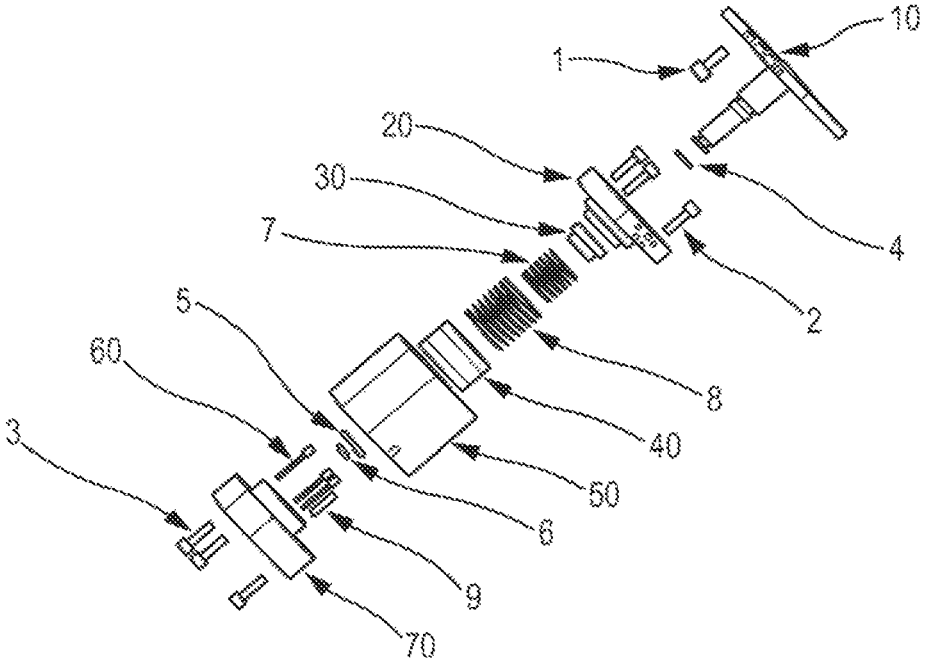
Figure 3:
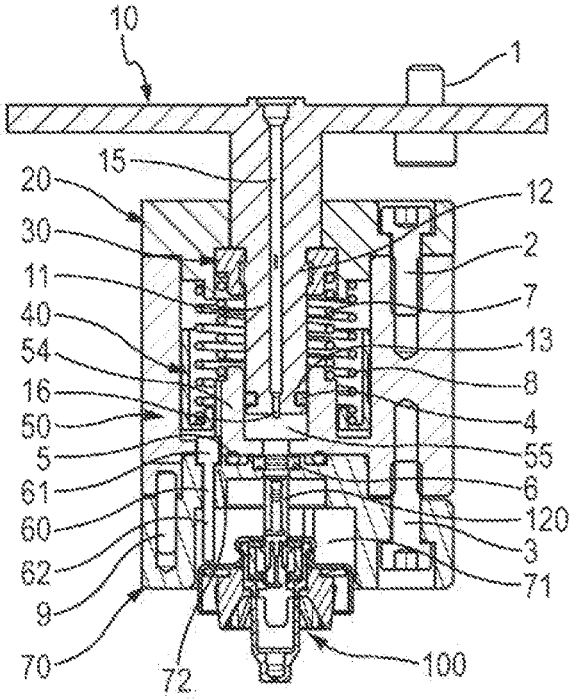
Figure 4:
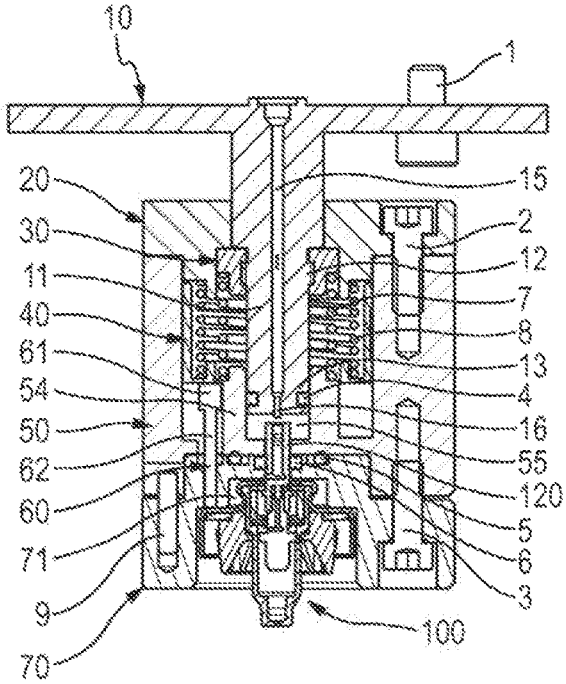
Figure 5:
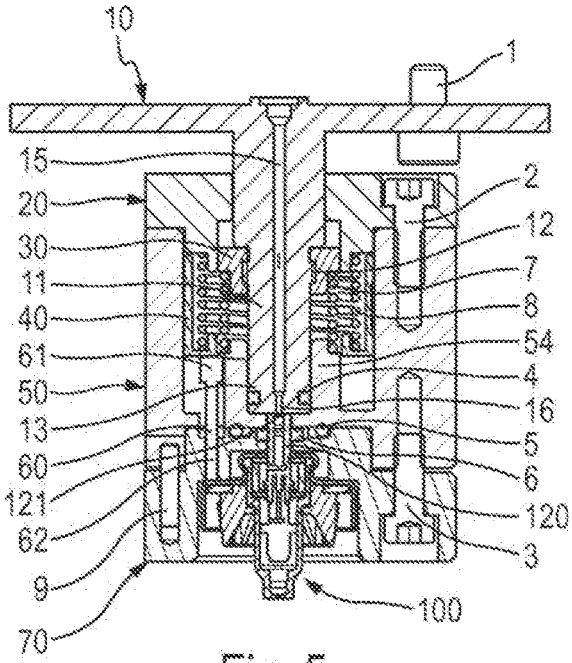
Figure 6:
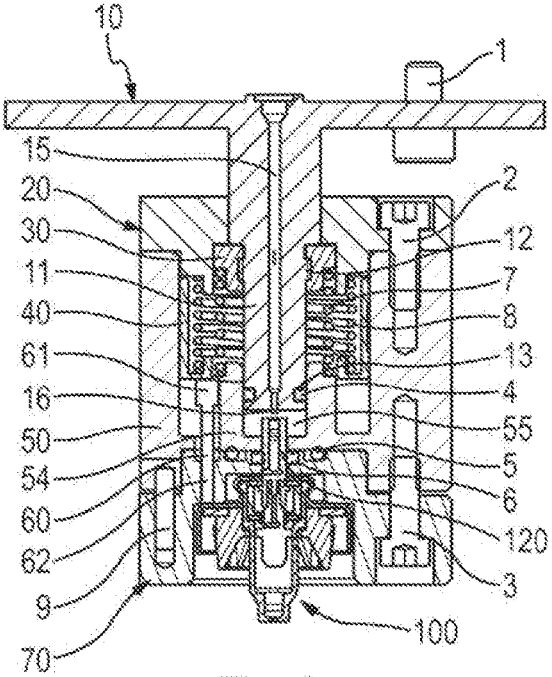
Figure 7:
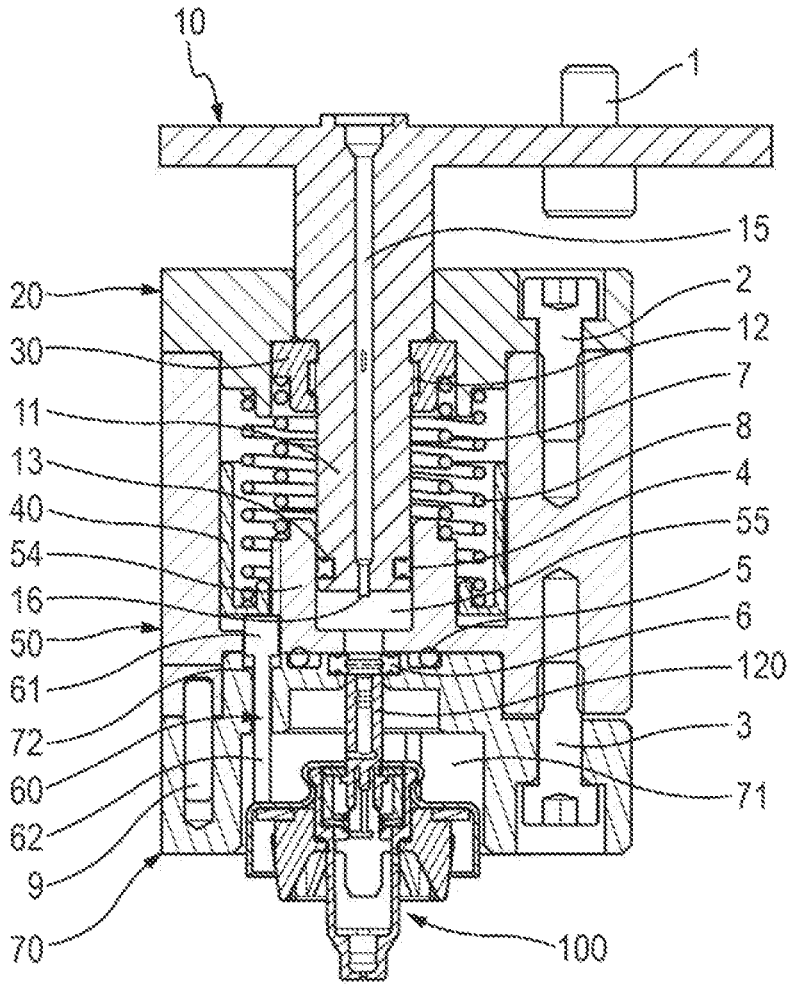

These features and advantages and others of the present invention will appear more clearly from the following detailed description thereof, made by way of non-limiting examples and with reference to the accompanying drawings, and in which:

FIG. 1 is a diagrammatic view in cross section of a dispensing valve in accordance with an advantageous embodiment, in the rest position of the valve shutter, in the upright filling and storage position of the valve, FIG. 2 is an exploded diagrammatic view of a filling head in accordance with an advantageous embodiment, FIG. 3 is a cross-sectional view of the filling head of FIG. 2 at the start of the filling cycle before inserting the valve, FIG. 4 is a view similar to that of FIG. 3, after insertion of the valve and before filling, FIG. 5 is a view similar to that of FIG. 4, during filling, FIG. 6 is a view similar to that of FIG. 5, after filling, and FIG. 7 is a view similar to that of FIG. 6, after ejection of the valve.

In the description below, the terms "top", "bottom", "lower", "upper" and "vertical" refer to the upright position represented in FIGS. 3 to 7, and the terms "axial" and "radial" are with respect to the longitudinal central axis X of the valve.

FIG. 1 represents a valve 100 in the upright filling position, i.e. the position in which the valve is disposed above the reservoir 200, of which only the neck 201 is shown in a diagrammatic manner. The valve 100 shown in this example is a metering valve.

The metering valve represented in FIG. 1 comprises a valve body 110 extending along a longitudinal central axis X. Inside said valve body 110, a valve shutter 120 slides between a rest position, which is the position shown in FIG. 1, and a dispensing position in which the valve shutter 120 has been pushed axially downwards inside the valve body 110.

This valve 100 is assembled on a reservoir 200 adapted to contain a fluid product and a propellant by means of a securing element 130, which may be a capsule which can be secured by crimping, screw fastening or snap fastening, with an interposed neck gasket 140.

Optionally, a ring 150 may be mounted around the valve body 110, in particular in order to decrease the dead volume in the inverted position for use and/or to limit contact between the fluid product and the neck gasket 140. This ring 150 may be of any shape, and the example of FIG. 1 is not limiting. In general, the reservoir 200 is intended to contain the fluid product and the propellant, in particular a formulation constituted by one or more active principles in suspension and/or in solution in a liquefied propellant, and optionally excipients. The propellant advantageously comprises an HFA gas, for example HFA 134a and/or HFA 227. Preferably, the propellant comprises HFA-152a. In a variation, other non-harmful gases such as HFO1234ze may be used.

The valve shutter 120 is urged towards its rest position by a spring 160 which is disposed in the valve body 110 and which cooperates with the valve body 110 on the one hand and with the valve shutter 120 on the other hand, preferably with a radial collar 129 of the valve shutter 120. A metering chamber 170 is defined inside the valve body 110, said valve shutter 120 sliding inside said metering chamber 170 so as to allow its contents to be dispensed when the valve is actuated.

Advantageously, the valve shutter 120 is produced in a single piece, namely an upper portion (also known as an upper valve shutter) and a lower portion 32 (also known as a lower valve shutter). The upper portion 31 comprises a central axial channel 122 provided with an axial outlet orifice 121 and a radial inlet channel 123 which is disposed in the metering chamber 170 when the valve shutter 120 is in its dispensing position. The lower portion comprises an inner axial channel 125 provided with a radial outlet channel 124. The lower portion also comprises the collar 129 on its outer surface.

The inner axial channel 125 makes it possible to connect the metering chamber 170 to the reservoir, so as to fill said metering chamber 170 before each use. This filling is carried out when the device is in its inverted position for use, with the valve 100 disposed below the reservoir 200.

In the example of FIG. 1, when the valve shutter 120 is in its rest position, the metering chamber 170 is connected to the reservoir 1 via the inner axial channel 125 of the valve shutter 120. In this rest position, the metering chamber 170 therefore remains connected to the reservoir 1 and can be emptied under gravity in the upright position in FIG. 1. The valve represented in FIGS. 1 and 2 is therefore a valve of the non-priming type. However, the invention is also applicable to other types of valve, in particular valves of the retention type.

The valve body 110 comprises a cylindrical portion 115 in which the spring 160 is disposed, and in which the collar 129 slides between the rest and dispensing positions. In the position of FIG. 1, this cylindrical portion 115 is the lower portion of the valve body. This cylindrical portion 115 comprises one or more longitudinal openings 111, such as slots, extending laterally in said cylindrical portion 115 of the valve body, over a portion of the axial height of the valve body in the direction of the central longitudinal axis. These openings 111 make it possible to fill the metering chamber 170 before each actuation, when in the inverted position of use (with the valve disposed below the reservoir), the valve shutter 120 being in its rest position.

The metering chamber 170 is defined between two annular gaskets, a top gasket or valve shutter gasket 171 and a bottom gasket or chamber gasket 172, in a well-known manner. This metering chamber 170 is filled before each actuation with a dose of fluid product from the reservoir, when the user turns the device over into the inverted position.

The volume of the metering chamber 170 is defined by means of a chamber insert 175, of substantially cylindrical shape, with a cylindrical wall having a radial thickness which is greater or smaller, depending on the desired volume. This volume may advantageously vary between 25 and 75 μL.

On its radially inner edge, the chamber gasket 172 advantageously comprises a radial sealing lip 173 in order to improve the dynamic seal with the valve shutter 120 during its displacement during the actuation of the valve. This deformable lip 173 extends radially inwards and axially downwards. This implementation makes it possible to ensure a perfect seal when the valve shutter 120 displaces in one direction and then in the other direction during an actuation. In addition, this radial sealing lip enables the reservoir to be filled easily through the valve without risk of damaging the bottom gasket 172, as will be described below.

FIGS. 2 to 7 describe a filling head of a filling device in accordance with an advantageous embodiment.

This filling head comprises the following elements: a control member 10, an upper plate 20, a supporting ring 30, an ejector cylinder 40, a body 50, at least one ejector 60 and a receiving plate 70.

In the example in FIG. 2, there are three ejectors 60, advantageously disposed at 120° from one another, but any number of ejectors is possible.

First securing means 1 are provided for securing the control member 10 to the motor (not shown) of the filling device, second securing means 2 are provided for securing the upper plate 20 to the body 50, and third securing means 3 are provided for securing the receiving plate 70 to the body 50. These different fastening means may respectively be formed by one or more screws or the like.

A first gasket 4 is provided on the control member 10 in order to cooperate with a portion of the body 50 when the control member 10 is displaced relative to the body 50. This first gasket 4 is a dynamic gasket, and may be formed by an O-ring gasket or X-ring gasket assembled in a suitable groove 13 of the control member 10. A second gasket 5 is provided between the body 50 and the receiving plate 70. This second gasket 5 is a static gasket, and may be formed by an O-ring gasket or X-ring gasket wedged between the body 50 and the receiving plate 70. A third gasket 6 is provided between the receiving plate 70 and the valve shutter 120. This third gasket 6 is a dynamic gasket and may be formed by an O-ring gasket or X-ring gasket disposed in a suitable recess of the receiving plate 70 in order to cooperate with an outer side wall of the valve shutter 120.

A first spring 7 is provided between the supporting ring 30, secured to the control member 10, and the body 50. A second spring 8 may optionally be provided between the upper plate 20 and the ejector cylinder 40.

A centering pin 9 may be provided between the body 50 and the receiving plate 70.

The assembly of the filling head of FIG. 2 can be carried out as follows.

The receiving plate 70 is secured to the body 50 by the third securing means 3 after positioning the centering pin 9 and the second and third gaskets 5 and 6.

According to the invention, the filling head comprises means for ejecting the valve after filling. Each ejector 60 is advantageously inserted into the body 50 from above. Each ejector 60 comprises an enlarged head 61 and a stem 62 extending axially downwards from said head. The stem 62 passes through the body 50 and the receiving plate 70 through appropriate openings, while the head is axially retained by a shoulder 72 of the receiving plate 70. In the rest position, each ejector is therefore positioned with the enlarged head 62 in abutment against the respective shoulder 72 and the stem 62 extending into a housing 71 of the receiving plate 70.

The ejector cylinder 40 is then inserted into the body 50 from above, with the bottom wall of said ejector cylinder 40 cooperating with the enlarged head of each ejector 60.

The first and second springs 7 and 8 are inserted into the body 50 from above, with the first spring 7 bearing directly on an inner portion of the body 50 and the second spring 8 bearing on the bottom wall of the ejector cylinder 40. In the example shown, the two springs 7, 8 are concentric, with the first spring 7 being radially inside the second spring 8. Other embodiments are also possible. As explained below, the second spring 8 is optional.

The control member 10 comprises an axial stem portion 11 which comprises a securing profile 12, for example a snap fastening profile or a screw fastening profile, intended to receive the supporting ring 30 and a groove or recess 13 intended to receive the first gasket 4. The upper plate 20 is perforated at its centre and is disposed around the axial stem portion 11 of the control member. The supporting ring 30 is inserted into the lower portion of the upper plate 20 from below in order to snap or screw onto the securing profile 12 of the axial stem portion 11.

This assembly is then secured to the body 50 by means of second securing means 2, with the first spring 7 cooperating with the supporting ring 30 and the second spring 8 cooperating with the upper plate 20.

The at least one ejector 60 and the ejector cylinder 40 are axially displaceable in the body 50 between an ejection position and a filling position, in which each ejector 60 is displaced axially upwardly in the body 50, causing the axial upward displacement of the ejector cylinder 40 and the compression of the second spring 8 thereby.

The control member 10 comprises a filling channel 15 which extends axially at the centre of the axial stem portion 11, and for which the lower axial end, which comprises an outlet orifice 16, opens into a receiving space 55 of the body 50 defined by a hollow cylindrical sleeve 54 of the body 50.

The control member 10 is therefore axially displaceable in the body 50 between its rest position and its filling position. During this axial displacement, the first gasket 4 cooperates in a sealed manner with said hollow axial sleeve 54 in order to keep said receiving space 55 sealed. In addition, when the control member 10 is displaced towards its filling position, the first spring 7 compresses so as to bring the control member 10 back to its rest position when filling is complete.

The operation of the filling head of FIG. 2 is illustrated in FIGS. 3 to 7.

This filling head is what is known as a hold-down head, i.e. the pressure that it exerts on the valve is applied on the one hand to the valve shutter 120 and on the other hand to the radially outer portion of the securing element 130, i.e. the portion which cooperates with the reservoir 200 via the neck gasket 140. Therefore there are no stresses exerted by the filling head on the radially inner portion of the securing element 130, i.e. the portion which cooperates with the valve body 110 via the valve shutter gasket 171. In addition, no stresses are exerted by the control member 10 on the valve body 110 via the valve shutter 120 beyond what is allowed by the calibration of the valve spring 160.

In addition, in contrast to existing filling heads, the seal between the head and the valve shutter is not obtained by means of a gasket disposed axially above the radially upper edge of the valve shutter, which defines the outlet orifice 121 of the valve shutter, but on a lateral side of the valve shutter. Thus, as can be seen in FIGS. 3 and 4, when the valve is inserted into the filling head, the top of the valve shutter penetrates into the receiving space 55 via an axial opening in the receiving plate 70 aligned with an axial opening in the body 50, with the third gasket 6 cooperating in a sealed manner with the outer side wall of the valve shutter, as can be seen in FIGS. 5 and 6.

During this insertion of the valve into the head, the at least one ejector 60, which protrudes into a housing 71 formed in the receiving plate at rest 70, is pushed upwards by the securing element 130 of the valve, as can be seen in FIGS. 3 and 4, which also displaces the ejector cylinder 40 and compresses the second spring 8.

When the valve shutter 120 arrives in the receiving space 55 of the body, in abutment against the lower edge of the axial stem portion 11 of the control member 10, the filling process can begin. Advantageously, the outlet orifice 16 of the filling channel 15 forms a small projection which can penetrate slightly into the axial outlet orifice 121 of the valve shutter 120. As can be seen in FIG. 5, the control member 10 is displaced axially downwards, which displaces the valve shutter 120 towards its filling position. The pressurized fluid product can then be injected through the filling channel 15 of the control member in order to pass into the valve shutter 120 and then to the reservoir 200. During this pressurized filling, sealing of the receiving space 55 is ensured by the first gasket 4 between the control member 10 and the body 50, by the second gasket 5 between the body 50 and the receiving plate 70, and by the third gasket 6 between the receiving plate 70 and the valve shutter 120.

At the end of filling, the first spring 7 returns the control member 10 to the rest position, as illustrated in FIG. 6, and the at least one ejector 60 ejects the valve from the housing 71 of the receiving plate 70, via the ejector cylinder 40 and the second spring 8, as illustrated in FIG. 7.

It should be noted that the ejection means, in this case the ejectors 60 and the associated elements, namely the ejector sleeve 40 and the second spring 8, are not mandatory for the proper operation of the filling head. One advantage of using such ejection means is to guarantee a good separation between the valve and the head. In fact, because of the seal produced on a side wall of the valve shutter 120, there is some resistance to the retraction of the valve from the housing 71 of the receiving plate 70, and the use of ejectors 60 may be advantageous.

An advantage of the filling head described above is the better control of the position of the valve shutter in the valve during filling, which is less subject to variability due on the one hand to the absence of a gasket disposed axially between the upper edge of the valve shutter 120 and the lower edge of the axial stem portion 11 of the control member 10, on the other hand to the absence of contact between the filling head and the radially inner portion of the securing element 130, and also to the fact that the turns of the spring 160 of the valve do not become contiguous in the filling position. The only contact between the head and the securing element is envisaged only on the radially outer portion of the securing element, which eliminates the variability linked to the gasket of the valve shutter and furthermore protects the valve body, and in particular the metering chamber, from any stresses during filling.

Although the present invention has been described above with reference to a particular embodiment thereof, it should be understood that it is not limited by the example shown. On the contrary, any useful modification could be applied thereto by a person skilled in the art without going beyond the scope of the present invention as defined in the accompanying claims.

The invention claimed is:

1. A filling head for a device for dispensing a fluid product, comprising a valve mounted on a reservoir by means of a securing element, said valve comprising a valve shutter provided with an axial outlet orifice sliding in a valve body, said filling head comprising:

a body comprising a receiving space, a control member mounted so as to slide axially in said body between a rest position and a filling position, said control member comprising a filling channel through which, in the filling position, the pressurized fluid product is fed to said valve in order to fill said reservoir, said filling channel comprising an outlet orifice opening into said receiving space, an upper plate through which said control member passes and which is secured to said body, a supporting ring secured to said control member and cooperating with a first spring disposed between said supporting ring and said body, a receiving plate secured to said body and comprising a housing for receiving said valve such that, in the filling position, the axial outlet orifice of said valve shutter opens into said receiving space, in which, in the filling position, said receiving space has a seal comprising a first gasket between said control member and said body, a second gasket between said body and said receiving plate, and a third gasket between said receiving plate and said valve shutter, said third gasket cooperating with an outer side wall of said valve shutter, and valve ejection means for ejecting said valve from said housing after filling, characterized in that said ejection means comprise:

an ejector cylinder disposed in said body, at least one ejector which is axially displaceably disposed in said body between an ejection position and a filling position, each ejector being disposed between said ejector cylinder and said support plate, each ejector comprising an enlarged head and a stem extending axially downwards from said enlarged head, said stem passing through said body and said receiving plate in order to project into said housing in the ejection position, and a second spring disposed between said ejector sleeve and said upper plate and urging said at least one ejector towards its ejection position.

2. The head as claimed in claim 1, in which said first gasket is a dynamic gasket formed by an O-ring gasket or X-ring gasket assembled in a groove or recess of said control member.

3. The head as claimed in claim 1, in which said second gasket is a static gasket formed by an O-ring gasket or X-ring gasket wedged between said body and said receiving plate.

4. The head as claimed in claim 1, in which said third gasket is a dynamic gasket formed by an O-ring gasket or X-ring gasket disposed in a suitable recess of said receiving plate.

5. The head as claimed in claim 1, in which, in the filling position, said filling head forms only two zones of contact with said valve, the first zone of contact being produced between said control member and said valve shutter and the second zone of contact being produced between said support plate or an element connected to said support plate and a radially outer portion of said securing element.

6. The head as claimed in claim 1, in which three ejectors are provided, spaced apart by 120°.

7. The head as claimed in claim 1, in which said receiving space is formed in a hollow cylindrical sleeve of the body in which said control member slides axially in a sealed manner between its rest and filling positions.

8. An assembly formed by a filling head as claimed in claim 1 and a device for dispensing a fluid product comprising a valve mounted on a reservoir by means of a securing element.

9. The assembly as claimed in claim 8, in which said valve comprises a valve shutter provided with an axial outlet orifice sliding in a valve body, in which, in the filling position, said valve shutter is disposed in said receiving space of said body and said securing element is disposed in said housing of said receiving plate.

* * * * *